US010632648B2

(12) United States Patent
Kimata et al.

(10) Patent No.: US 10,632,648 B2
(45) Date of Patent: Apr. 28, 2020

(54) CERAMIC FORMED BODY EXTRUSION METHOD, CERAMIC FORMED BODY, AND CERAMIC POROUS BODY

(71) Applicant: NGK Insulators, Ltd., Nagoya (JP)

(72) Inventors: Takafumi Kimata, Nagoya (JP); Kenichi Hidaka, Nagoya (JP); Yoshio Kikuchi, Nagoya (JP); Masaki Ishikawa, Nagoya (JP); Kisuke Yamamoto, Nagoya (JP); Kenji Morimoto, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 16/526,026

(22) Filed: Jul. 30, 2019

(65) Prior Publication Data

US 2019/0351578 A1 Nov. 21, 2019

Related U.S. Application Data

(62) Division of application No. 15/471,327, filed on Mar. 28, 2017.

(30) Foreign Application Priority Data

Mar. 30, 2016 (JP) ..... 2016-069762
Mar. 27, 2017 (JP) ..... 2017-061217

(51) Int. Cl.

| | |
|---|---|
| ***B28B 3/26*** | (2006.01) |
| ***B28B 11/16*** | (2006.01) |
| *B28B 3/20* | (2006.01) |

(52) U.S. Cl.
CPC ..... *B28B 3/269* (2013.01); *B28B 3/26* (2013.01); *B28B 11/16* (2013.01); *B28B 2003/203* (2013.01)

(58) Field of Classification Search
CPC .... B28B 3/269; B28B 11/16; B28B 2003/203
See application file for complete search history.

(56) References Cited

U.S. PATENT DOCUMENTS

2006/0290036 A1* 12/2006 Kaneda ..... B28B 3/269 264/628

FOREIGN PATENT DOCUMENTS

| | | | |
|---|---|---|---|
| JP | H11-139887 | A1 | 5/1999 |
| JP | 2005-081609 | A1 | 3/2005 |
| JP | 2006-225250 | A1 | 8/2006 |
| JP | 4669925 | B2 | 4/2011 |

* cited by examiner

*Primary Examiner* — Robert D Harlan
(74) *Attorney, Agent, or Firm* — Burr & Brown, PLLC

(57) ABSTRACT

A ceramic formed body extrusion method for forming a ceramic formed body having a wall-shaped or plate-shaped formed portion by using an extrusion die provided with a slit for extrusion of a ceramic formed body from a raw material for forming, the slit including a slit former stage unit located on an upstream side in an extrusion direction in the extrusion and a slit latter stage unit located on a downstream side in the extrusion direction, the slit latter stage unit having a width of three to 27 times a width of the slit former stage unit, and by extruding a raw material containing a first particle having an aspect ratio of two or more and less than 300 such that the raw material passes though the slit former stage unit of the extrusion die and then passes through the slit latter stage unit.

2 Claims, 5 Drawing Sheets

CERAMIC FORMED BODY EXTRUSION METHOD, CERAMIC FORMED BODY, AND CERAMIC POROUS BODY

CROSS REFERENCE TO RELATED APPLICATIONS

This application is a division of U.S. application Ser. No. 15/471,327, filed Mar. 28, 2017, and claims priority of Japanese Patent Application No. 2016-069762, filed Mar. 30, 2016, and Japanese Patent Application No. 2017-061217, filed Mar. 27, 2017, the entireties of which are incorporated herein by reference.

FIELD OF THE INVENTION

The present invention relates to a ceramic formed body extrusion method, a ceramic formed body formed by the method, and a ceramic porous body. More specifically, the present invention relates to a ceramic formed body extrusion method capable of forming a ceramic formed body which contains a particle of a high aspect ratio (first particle) and in which the particle is oriented such that a length direction of the particle is approximately parallel to a thickness direction of a wall-shaped or plate-shaped formed portion, and a ceramic formed body obtained by the method.

BACKGROUND OF THE INVENTION

Conventionally, a ceramic porous body has been used as a filter such as a diesel particulate filter (DPF) or a water treatment filter (for example, refer to Patent Documents 1 and 2). Usually, a ceramic porous body used as a filter has a wall-shaped or plate-shaped portion, and traps a solid particle or the like contained in fluid by causing the fluid to permeate through the portion as a filter layer.

For example, as the ceramic porous body used as DPF, a honeycomb-shaped ceramic porous body (honeycomb structure) having partition walls for defining a plurality of cells is used widely. By plugging ends of cells adjacent to each other alternately (in a checkered pattern) in such a honeycomb structure, a filter capable of trapping a particulate matter (PM) contained in an exhaust gas from diesel engine or the like is obtained.

That is, when an exhaust gas flows in a predetermined cell (inflow cell) from one end in the plugged honeycomb structure, the exhaust gas passes through a porous partition wall, moves to an adjacent cell (outflow cell), and is then emitted. When the exhaust gas permeates through the partition wall, the partition wall functions as a filter layer, and traps PM contained in the exhaust gas.

A ceramic porous body used for such a filter requires high gas permeation performance in order to reduce a pressure loss. Here, as one of means for improving gas permeation performance, it is considered to form a pore in a wall-shaped or plate-shaped portion (for example, a partition wall of a honeycomb structure) serving as a filter layer into a shape of a high aspect ratio, such as an elongated shape, and to orient the pore such that a length direction of the pore is parallel to a thickness direction of the portion. By orienting the pore in the portion in this way, the number of pores communicating in the thickness direction of the portion is increased. Therefore, a permeation path of fluid such as gas is short to obtain high permeation performance.

For example, a pore of a high aspect ratio can be formed by using a pore former of a high aspect ratio in a fiber shape or the like (for example, refer to Patent Document 3). However, it is difficult to orient such a pore former of a high aspect ratio such that a length direction thereof is parallel to a thickness direction of a wall-shaped or plate-shaped portion serving as a filter layer.

That is, a ceramic porous body used as a filter is usually manufactured by forming a ceramic formed body (for example, a honeycomb formed body) having a wall-shaped or plate-shaped formed portion from a raw material for forming using extrusion capable of mass production at low cost and firing the ceramic formed body. A die conventionally used for extrusion of a ceramic formed body has a raw material supply surface and a raw material forming surface opposite to the raw material supply surface. At least one introduction hole for introducing a raw material for forming is provided in the raw material supply surface. On the other hand, a slit (forming groove) for extrusion of a ceramic formed body having a wall-shaped or plate-shaped formed portion from a raw material is provided in the raw material forming surface. The introduction hole communicates with the slit in the die. A raw material introduced into the die from the introduction hole passes through the slit, and thereby becomes a ceramic formed body having a wall-shaped or plate-shaped formed portion in a predetermined thickness (for example, refer to Patent Document 2).

In such a conventional ceramic formed body extrusion method using a die, in a case where a raw material for forming contains a particle of a high aspect ratio (for example, a pore former), when the raw material passes through a narrow slit, the particle is oriented such that a length direction thereof is parallel to an extrusion direction of a formed body. Here, the extrusion direction of the ceramic formed body is a direction perpendicular to a thickness direction of a wall-shaped or plate-shaped formed portion, and is not a direction parallel to a thickness direction of the formed portion. That is, by such a conventional ceramic formed body extrusion method, it is not possible to obtain a ceramic formed body which contains a particle (for example, a pore former) of a high aspect ratio and in which the particle is oriented such that a length direction of the particle is parallel to a thickness direction of a wall-shaped or plate-shaped formed portion.

Note that Patent Document 3 discloses a method for manufacturing a ceramic porous body having a pore oriented almost in one direction using a pore former of a high aspect ratio. However, even by this manufacturing method, the pore former of a high aspect ratio is oriented such that a length direction thereof is parallel to an extrusion direction of a formed body (refer to FIGS. 3 and 6 in Patent Document 3). Therefore, even by using the manufacturing method disclosed in Patent Document 3, it is not possible to obtain a ceramic formed body which contains a particle (for example, a pore former) of a high aspect ratio and in which the particle is oriented such that a length direction of the particle is parallel to a thickness direction of a wall-shaped or plate-shaped formed portion.

In addition, conventionally, a method for manufacturing a precursor of a porous ceramic having a unidirectional through hole derived from a gap between ceramic formed bodies by assembling a plurality of the ceramic formed bodies in one layer and then performing compression molding has been disclosed (refer to Patent Document 4). However, mass production is more difficult and manufacturing cost is higher in this method than in the above extrusion method.

[Patent Document 1] JP-A-2006-225250
[Patent Document 2] JP-A-2005-81609
[Patent Document 3] JP-B-4669925
[Patent Document 4] JP-A-11-139887

SUMMARY OF THE INVENTION

The present invention has been achieved in view of such a conventional circumstance. That is, an object of the present invention is to provide a ceramic formed body extrusion method capable of forming a ceramic formed body which contains a particle of a high aspect ratio and in which the particle is oriented such that a length direction of the particle is approximately parallel to a thickness direction of a wall-shaped or plate-shaped formed portion. In addition, another object of the present invention is to provide a ceramic formed body obtained by such an extrusion method. Still another object of the present invention is to provide a ceramic porous body having high permeation performance of fluid.

In order to achieve the above objects, the present invention provides the following ceramic formed body extrusion method, ceramic formed body, and ceramic porous body.

According to a first aspect of the present invention, a ceramic formed body extrusion method for forming a ceramic formed body having a wall-shaped or plate-shaped formed portion by using an extrusion die provided with a slit for extrusion of a ceramic formed body having a wall-shaped or plate-shaped formed portion from a raw material for forming is provided, the slit including a slit former stage unit located on an upstream side in an extrusion direction in the extrusion and a slit latter stage unit located on a downstream side in the extrusion direction, the slit latter stage unit having a width of three to 27 times a width of the slit former stage unit, and by extruding a raw material containing a first particle having an aspect ratio of two or more and less than 300 such that the raw material passes though the slit former stage unit of the extrusion die and then passes through the slit latter stage unit.

According to a second aspect of the present invention, the ceramic formed body extrusion method described in the first aspect is provided, in which a length of the first particle is 50% or less of a width of the slit latter stage unit.

According to a third aspect of the present invention, the ceramic formed body extrusion method described in the first or second aspects is provided, in which the first particle is a pore former.

According to a fourth aspect of the present invention, the ceramic formed body extrusion method described in any one of the first to third aspects is provided, in which an addition amount of the first particle is 70% by volume or less with respect to a whole of the raw material.

According to a fifth aspect of the present invention, the ceramic formed body extrusion method described in any one of the first to fourth aspects is provided, in which the width of the slit latter stage unit is 8 mm or less.

According to a sixth aspect of the present invention, the ceramic formed body extrusion method described in any one of the first to fifth aspects is provided, in which the length of the slit latter stage unit in the extrusion direction is 13 mm or less.

According to a seventh aspect of the present invention, the ceramic formed body extrusion method described in any one of the first to sixth aspects is provided, in which the raw material contains at least one ceramic raw material selected from the group consisting of silicon carbide, cordierite, aluminum titanate, zirconia, aluminum oxide, a silicon carbide forming raw material, a cordierite forming raw material, an aluminum titanate forming raw material, and a zirconia forming raw material.

According to an eighth aspect of the present invention, the ceramic formed body extrusion method described in any one of the first to seventh aspects is provided, in which the extrusion die has at least one introduction hole communicating with the slit and provided to introduce the raw material into the slit.

According to a ninth aspect of the present invention, the ceramic formed body extrusion method described in any one of the first to eighth aspects is provided, in which the ceramic formed body is a honeycomb-shaped ceramic formed body having partition walls for defining a plurality of cells, and the partition wall is the wall-shaped or plate-shaped formed portion.

According to a tenth aspect of the present invention, the ceramic formed body extrusion method described in any one of the first to ninth aspects is provided, in which the raw material contains a second particle having an aspect ratio of less than two, and the second particle is a pore former.

According to an eleventh aspect of the present invention, a ceramic formed body having a wall-shaped or plate-shaped formed portion and containing a first particle having an aspect ratio of two or more and less than 300 is provided, in which in a dry state, among three regions obtained by equally dividing a cut surface obtained by cutting the formed portion in a thickness direction thereof into three parts in the thickness direction of the formed portion, the orientation degree of the first particle in a region located in the center in the thickness direction of the formed portion is from 0 to 53°.

According to a twelfth aspect of the present invention, the ceramic formed body described in the eleventh aspect is provided, in which a length of the first particle is 50% or less of a thickness of the formed portion.

According to a thirteenth aspect of the present invention, the ceramic formed body described in the eleventh or twelfth aspects is provided, in which the first particle is a pore former.

According to a fourteenth aspect of the present invention, the ceramic formed body described in any one of the eleventh to thirteenth aspects is provided, in which a content of the first particle is 45% by volume or less with respect to a whole of the raw material constituting the ceramic formed body.

According to a fifteenth aspect of the present invention, the ceramic formed body described in any one of the eleventh to fourteenth aspects is provided, in which the ceramic formed body is a honeycomb-shaped ceramic formed body having partition walls for defining a plurality of cells, and the partition wall is the wall-shaped or plate-shaped formed portion.

According to a sixteenth aspect of the present invention, the ceramic formed body described in any one of the eleventh to fifteenth aspects is provided, further containing a second particle having an aspect ratio of less than two, in which the second particle is a pore former.

According to a seventeenth aspect of the present invention, a ceramic porous body having partition walls having a plurality of pores for defining a plurality of cells is provided, in which among three regions obtained by equally dividing a cut surface obtained by cutting the ceramic porous body in a thickness direction of the partition walls into three parts in the thickness direction of the partition walls, the orientation degree of the pores in a central region located in the center in the thickness direction of the partition walls is from 0 to 53°, and among the three regions, a difference between a porosity in a surface region outside the central region and a porosity of the partition walls is from 0 to 11%.

According to an eighteenth aspect of the present invention, the ceramic porous body described in the seventeenth aspect is provided, in which the porosity of the partition walls is 65% or less.

Advantageous Effects of Invention

By the ceramic formed body extrusion method according to an aspect of the present invention, it is possible to form a ceramic formed body which contains a particle of a high aspect ratio (first particle) and in which the particle is oriented such that a length direction of the particle is approximately parallel to a thickness direction of a wall-shaped or plate-shaped formed portion. In addition, this method uses extrusion, and therefore can manufacture such a ceramic formed body as described above at low cost efficiently. In addition, when a ceramic formed body formed by this method contains a pore former as the first particle, by burning the pore former by firing, a ceramic porous body which has a pore of a high aspect ratio and in which the pore is oriented such that a length direction of the pore is approximately parallel to a thickness direction of the formed portion is obtained. In addition, even when the particle of a high aspect ratio is not burned by firing a ceramic raw material or the like, a ceramic porous body in which a pore of a high aspect ratio is formed in a gap between first particles after firing and the pore is oriented such that a length direction of the pore is approximately parallel to a thickness direction of the formed portion is obtained. Such a ceramic porous body has many pores communicating in the thickness direction of the formed portion. Therefore, when the ceramic porous body is used as a filter, a permeation path of fluid such as gas is short, high permeation performance is obtained, and a pressure loss is reduced consequently.

In the ceramic formed body according to an aspect of the present invention, many particles of a high aspect ratio contained in the ceramic formed body are oriented such that a length direction thereof is approximately parallel to a thickness direction of a wall-shaped or plate-shaped formed portion. Therefore, when the particle is a pore former, by burning the pore former by firing the ceramic formed body according to an aspect of the present invention, a ceramic porous body which has a pore of a high aspect ratio and in which the pore is oriented such that a length direction of the pore is approximately parallel to a thickness direction of the formed portion is obtained. In addition, even when the particle of a high aspect ratio is not burned by firing a ceramic raw material or the like, a ceramic porous body in which a pore of a high aspect ratio is formed in a gap between first particles after firing and the pore is oriented such that a length direction of the pore is approximately parallel to a thickness direction of the formed portion is obtained. Such a ceramic porous body has many pores communicating in the thickness direction of the formed portion. Therefore, when the ceramic porous body is used as a filter, a permeation path of fluid such as gas is short, high permeation performance is obtained, and a pressure loss is reduced consequently. The ceramic porous body according to an aspect of the present invention has high permeation performance of fluid and a low pressure loss.

DETAILED DESCRIPTION OF THE INVENTION

Hereinafter, the present invention will be described based on a specific embodiment. However, the present invention should not be construed while being limited thereto, but various changes, modifications, or improvements can be added thereto based on knowledge of a person skilled in the art within a range not departing from the scope of the present invention.

(1) Ceramic Formed Body Extrusion Method:

A ceramic formed body formed by a ceramic formed body extrusion method according to an aspect of the present invention has a wall-shaped or plate-shaped formed portion. In the present invention, the "formed portion" means a portion formed by passing of a raw material for forming through a slit of an extrusion die. This "formed portion" has a constant cross-sectional shape in a length direction (extrusion direction at the time of extrusion) of the ceramic formed body. In addition, in the present invention, the "ceramic formed body having a wall-shaped or plate-shaped formed portion" includes a ceramic formed body in which a part thereof is a wall-shaped or plate-shaped formed portion and a ceramic formed body in which the whole thereof is a wall-shaped or plate-shaped formed portion. Examples of the "wall-shaped or plate-shaped formed portion" in the present invention include a partition wall in a honeycomb-shaped ceramic formed body (honeycomb formed body) having a plurality of cells defined by the partition wall. In addition, the "wall-shaped or plate-shaped formed portion" also includes the whole of the ceramic formed body in a plate-shaped (sheet-shaped) ceramic formed body and the whole of the ceramic formed body in a pipe-shaped ceramic formed body (pipe wall separating an inside of a pipe from an outside thereof).

Figure 1:
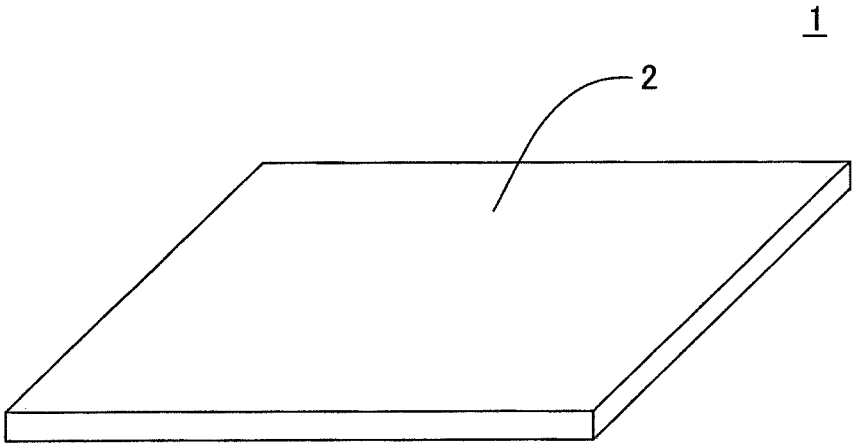
FIG. 1 is a perspective view schematically illustrating an example of a ceramic formed body formed by the ceramic formed body extrusion method according to an aspect of the present invention.
Figure 2:
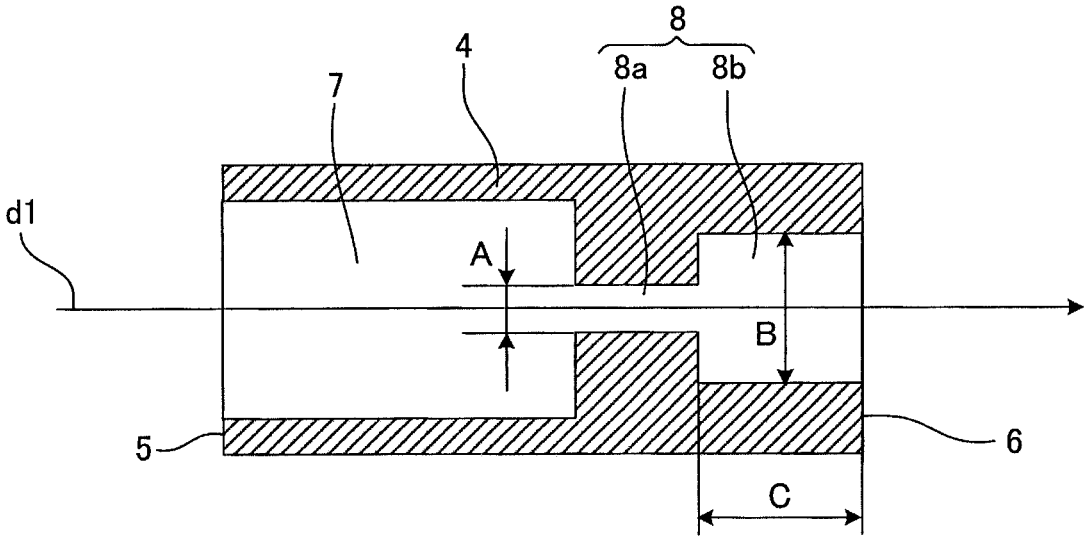
FIG. 2 is a cross-sectional view schematically illustrating an example of an extrusion die used in the ceramic formed body extrusion method according to an aspect of the present invention.

Note that hereinafter, as an example of an embodiment of the ceramic formed body extrusion method according to an aspect of the present invention, a case where a ceramic formed body formed by the method is a plate-shaped (sheet-shaped) ceramic formed body will be exemplified. As illustrated in FIG. 1, a ceramic formed body 1 formed in the present embodiment has a plate-shape (sheet-shape), and the whole of the ceramic formed body 1 is a wall-shaped or plate-shaped formed portion 2. In the present embodiment, an extrusion die 4 illustrated in FIG. 2 is used for extrusion of the ceramic formed body 1. The extrusion die 4 has a raw material supply surface 5 and a raw material forming surface 6 opposite to the raw material supply surface 5. At least one introduction hole 7 for introducing a raw material for forming is provided in the raw material supply surface 5. On the other hand, a slit (forming groove) 8 for extrusion of the plate-shaped (sheet-shaped) ceramic formed body 1 from a raw material is provided in the raw material forming surface 6. The introduction hole 7 communicates with the slit 8 in the extrusion die 4. The slit 8 includes a slit former stage unit 8*a* located on an upstream side in an extrusion direction d1 in extrusion and a slit latter stage unit 8*b* located on a downstream side in the extrusion direction d1. The width B of the slit latter stage unit 8*b* is three to 27 times the width A of the slit former stage unit 8*a*. Note that the introduction hole 7 is not an essential constituent element for the extrusion die 4 although the present embodiment uses the extrusion die 4 provided with the introduction hole 7. That is, the extrusion method according to an aspect of the present invention can be performed without the introduction hole 7 as long as the extrusion die 4 has the slit 8 (the slit former stage unit 8*a* and the slit latter stage unit 8*b*). In this case, a raw material for forming is introduced directly into the slit latter stage unit 8*b*.

In the ceramic formed body extrusion method according to an aspect of the present invention, a raw material containing a particle having an aspect ratio of two or more and less than 300 is used as a raw material for forming. Here, the "aspect ratio of a particle" means a ratio between a maximum diameter of a particle and a width perpendicular to the maximum diameter (maximum diameter/width perpendicular to maximum diameter). Note that the "maximum diameter of a particle" may be referred to as a "length of a particle" in the present invention. In addition, the "width perpendicular to a maximum diameter of a particle" may be referred to as a "thickness of a particle". Furthermore, the "first particle having an aspect ratio of two or more and less than 300" may be referred to as a "particle of a high aspect ratio" or a "particle 10".

Figure 3A:
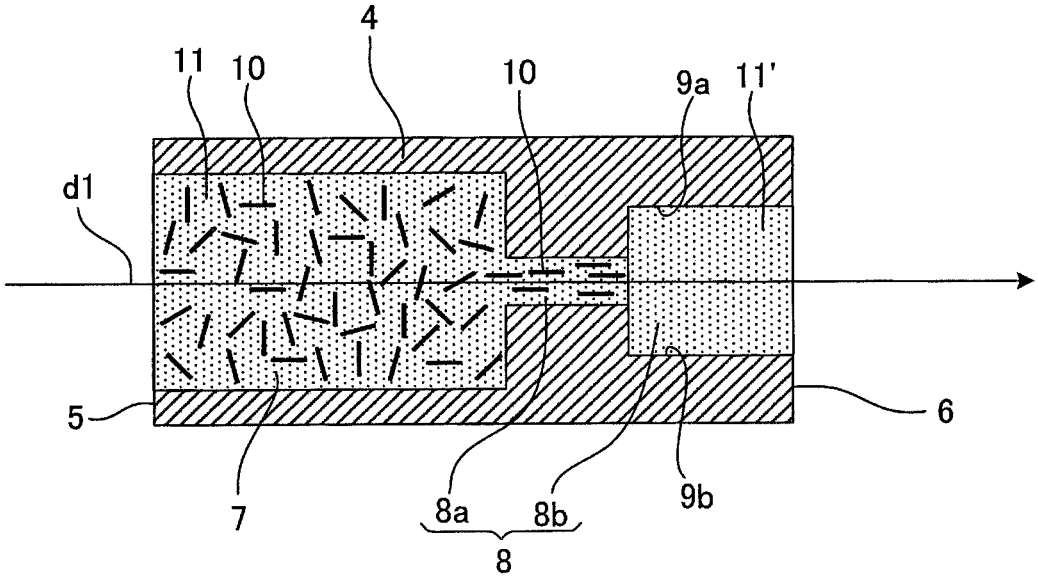
FIG. 3A is an explanatory diagram schematically illustrating the ceramic formed body extrusion method according to an aspect of the present invention.
Figure 3B:
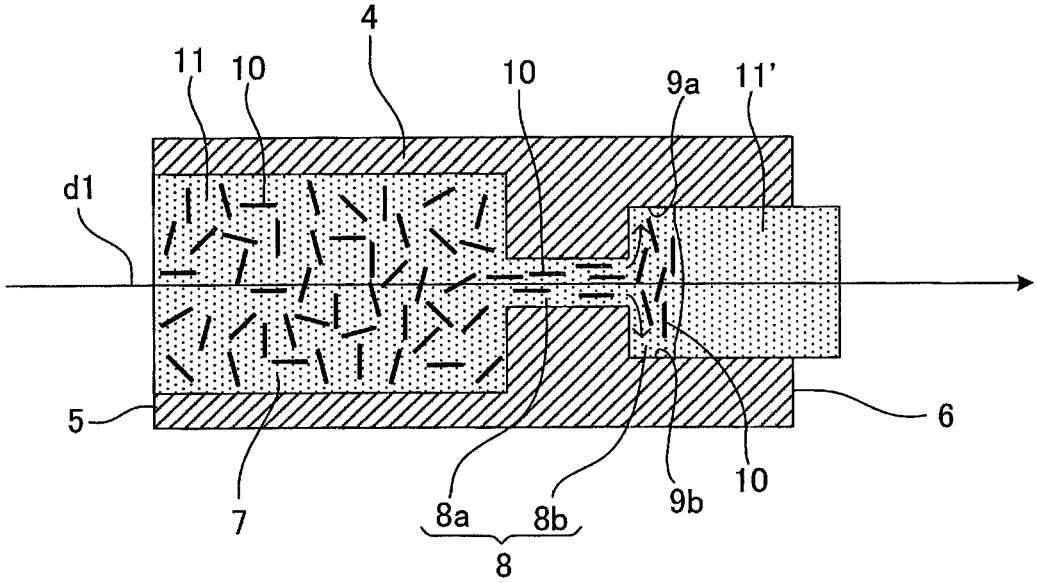
FIG. 3B is an explanatory diagram schematically illustrating the ceramic formed body extrusion method according to an aspect of the present invention.
Figure 3C:
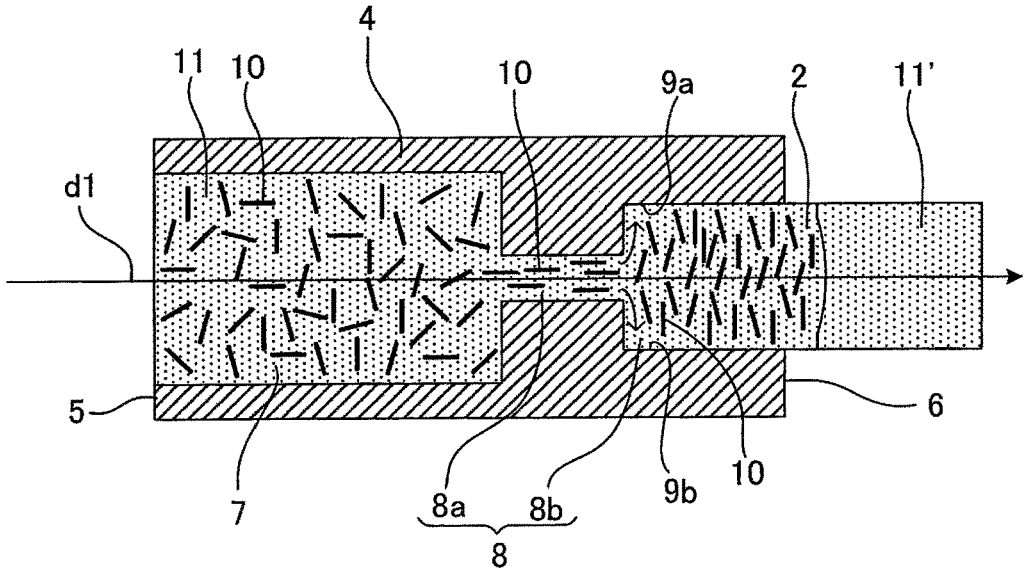
FIG. 3C is an explanatory diagram schematically illustrating the ceramic formed body extrusion method according to an aspect of the present invention.
Figure 4:
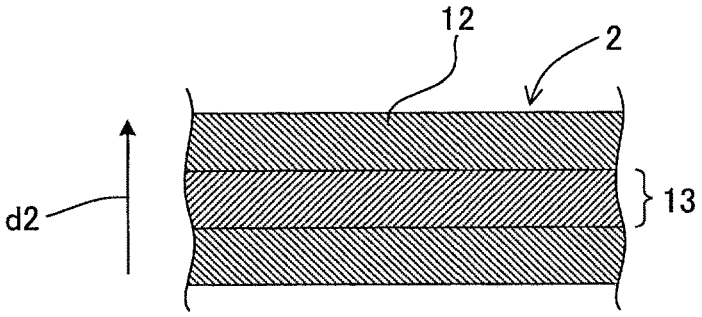
FIG. 4 is a cross-sectional view schematically illustrating three regions obtained by equally dividing a cut surface obtained by cutting a wall-shaped or plate-shaped formed portion in a thickness direction thereof into three parts in the thickness direction of the formed portion.

In the ceramic formed body extrusion method according to an aspect of the present invention, as illustrated in FIGS. 3A to 3C, a raw material (kneaded material) 11 containing a particle 10 of a high aspect ratio is introduced into the extrusion die 4 from the introduction hole 7, and the raw material 11 is extruded so as to pass through the slit former stage unit 8*a* and then pass through the slit latter stage unit 8*b*. As described above, the width B of the slit latter stage unit 8*b* is three to 27 times the width A of the slit former stage unit 8*a* in the extrusion die 4. When there is such a large difference between the width B of the slit latter stage unit 8*b* and the width A of the slit former stage unit 8*a*, a passing speed of the raw material 11 in the slit latter stage unit 8*b* is slower than a passing speed of the raw material 11 in the slit former stage unit 8*a*. Therefore, as illustrated in FIG. 3A, when the raw material 11 is extruded from the narrow slit former stage unit 8*a* to the wide slit latter stage unit 8*b*, advance of the raw material 11 in the extrusion direction d1 is inhibited by a raw material 11' having a slower passing speed, which has been extruded into the slit latter stage unit 8*b* previously. As a result, as illustrated in FIG. 3B, the raw material 11 cannot be diffused in the slit latter stage unit 8*b* in an isotropic manner, but flows in a width direction of the slit latter stage unit 8*b* (direction toward wall surfaces 9*a* and 9*b* facing each other, defining the slit latter stage unit 8*b*), and is pressure-bonded by the raw material 11'. Thereafter, as illustrated in FIG. 3C, the following raw material 11 also flows in the width direction of the slit latter stage unit 8*b*, and is pressure-bonded by the preceding raw material 11'. The raw material 11 is extruded from the slit latter stage unit 8*b* in the extrusion direction d1 after flowing in the width direction of the slit latter stage unit 8*b* and being pressure-bonded by the preceding raw material 11'. The extruded raw material 11 becomes the formed portion 2 having a thickness corresponding to the width B of the slit latter stage unit 8*b*, is extruded into an outside of the extrusion die 4 from the slit latter stage unit 8*b*, and becomes the ceramic formed body 1 having the formed portion 2.

Here, when a direction of the particle 10 of a high aspect ratio contained in the raw material 11 is focused on, as illustrated in FIG. 3A, first, in a process in which the raw material 11 passes through the narrow slit former stage unit 8*a*, the particle 10 is oriented such that a length direction thereof (maximum diameter direction) is approximately parallel to the extrusion direction d1. Then, as illustrated in FIG. 3B, the raw material 11 is extruded into the wide slit latter stage unit 8*b*. In a process in which the raw material 11 flows in the width direction of the slit latter stage unit 8*b*, the direction of the particle 10 is changed, and the particle 10 is oriented such that the length direction of the particle 10 is approximately perpendicular to the extrusion direction d1. Thereafter, as illustrated in FIG. 3C, while the particle 10 maintains such an oriented state, the raw material 11 becomes the formed portion 2 having a thickness corresponding to the width B of the slit latter stage unit 8*b*, and is extruded into an outside of the extrusion die 4 from the slit latter stage unit 8*b*.

In this way, the raw material 11 passes through the narrow slit former stage unit 8*a* and then flows in the wide slit latter stage unit 8*b*, and therefore an orientation direction of the particle 10 contained in the raw material 11 can be changed about by 90° at a maximum. Therefore, by the ceramic formed body extrusion method according to an aspect of the present invention, it is possible to form a ceramic formed body which contains a particle of a high aspect ratio and in which the particle is oriented such that a length direction of the particle is approximately parallel to a thickness direction of a wall-shaped or plate-shaped formed portion. Note that "approximately parallel" here includes an inclination angle of 0° to about 53° in the length direction of the particle of a high aspect ratio with respect to the thickness direction of the formed portion. In addition, this method uses extrusion, and therefore can manufacture such a ceramic formed body as described above at low cost efficiently. In addition, when a ceramic formed body formed by this method contains a pore former as the first particle, by burning the pore former by firing, a ceramic porous body which has a pore of a high aspect ratio and in which the pore is oriented such that a length direction of the pore is approximately parallel to a thickness direction of the formed portion is obtained. In addition, even when the particle of a high aspect ratio is not burned by firing a ceramic raw material or the like, a ceramic porous body in which a pore of a high aspect ratio is formed in a gap between first particles after firing and the pore is oriented such that a length direction of the pore is approximately parallel to a thickness direction of the formed portion is obtained. Such a ceramic porous body has many pores communicating in the thickness direction of the formed portion. Therefore, when the ceramic porous body is used as a filter, a permeation path of fluid such as gas is short, high permeation performance is obtained, and a pressure loss is reduced consequently.

In the ceramic formed body extrusion method according to an aspect of the present invention, the width B of the slit latter stage unit 8*b* of the extrusion die 4 is three to 27 times, preferably three to 15 times, and more preferably three to six times the width A of the slit former stage unit 8*a*. When the width B of the slit latter stage unit 8*b* is less than three times the width A of the slit former stage unit 8*a*, the raw material 11 extruded into the slit latter stage unit 8*b* from the slit former stage unit 8*a* hardly flows in the width direction of the slit latter stage unit 8*b*, and therefore the orientation direction of the particle 10 cannot be changed as described above. In addition, when the width B of the slit latter stage unit 8*b* is more than 27 times the width A of the slit former stage unit 8*a*, the raw material 11 is pressure-bonded by the preceding raw material 11' before flowing sufficiently in the width direction of the slit latter stage unit 8*b*. As a result, change in the orientation direction of the particle 10 is insufficient.

In the ceramic formed body extrusion method according to an aspect of the present invention, the width B of the slit latter stage unit 8*b* of the extrusion die 4 is preferably 8 mm or less, and more preferably 0.3 mm or less. By setting the width B of the slit latter stage unit 8*b* to such a value, parts of the raw material 11 which have flowed in the slit latter stage unit 8*b* are easily pressure-bonded to each other.

In the ceramic formed body extrusion method according to an aspect of the present invention, a length C of the slit latter stage unit 8*b* of the extrusion die 4 in the extrusion direction d1 is preferably 13 mm or less, and more preferably 3 mm or less. By setting the length C of the slit latter stage unit 8*b* to such a value, while the particle 10 oriented such that a length direction thereof is approximately perpendicular to the extrusion direction d1 maintains the oriented state, the raw material 11 is easily extruded into an outside of the extrusion die 4 from the slit latter stage unit 8*b*.

In the ceramic formed body extrusion method according to an aspect of the present invention, the length of the particle 10 is preferably 50% or less of the width B of the slit latter stage unit 8*b*, and more preferably 47% or less thereof. By setting the length of the particle 10 to such a value, the particle 10 is easily oriented such that the length direction of the particle 10 is approximately parallel to a thickness direction of the formed portion 2.

In the ceramic formed body extrusion method according to an aspect of the present invention, the addition amount of the particle 10 is preferably 70% by volume or less, more preferably 45% by volume or less, and still more preferably 35% by volume or less with respect to the whole of the raw material. By setting the addition amount of the particle 10 to such a value, a ceramic formed body containing a large amount of the particle 10 oriented such that the length direction of thereof is approximately parallel to the thickness direction of the formed portion 2 is easily obtained. Note that the lower limit value of the addition amount of the particle 10 is preferably 1% by volume with respect to the whole of the raw material.

In the ceramic formed body extrusion method according to an aspect of the present invention, the raw material 11 preferably contains at least one ceramic raw material selected from the group consisting of silicon carbide, cordierite, aluminum titanate, zirconia, aluminum oxide, a silicon carbide forming raw material, a cordierite forming raw material, an aluminum titanate forming raw material, and a zirconia forming raw material, and more preferably contains at least one ceramic raw material selected from the group consisting of silicon carbide, cordierite, aluminum titanate, aluminum oxide, a silicon carbide forming raw material, a cordierite forming raw material, and an aluminum titanate forming raw material. By firing such a ceramic formed body formed by using the raw material 11, a ceramic porous body having excellent strength and thermal shock resistance is obtained. Note that the "silicon carbide forming raw material" means a raw material which becomes silicon carbide by firing, and is a ceramic raw material with which a "predetermined raw material" is mixed so as to obtain a chemical composition of silicon in 30% by mass and carbon in 70% by mass. In addition, the "cordierite forming raw material" means a raw material which becomes cordierite by firing, and is a ceramic raw material with which a "predetermined raw material" is mixed so as to obtain a chemical composition of silica in 42 to 56% by mass, alumina in 30 to 45% by mass, and magnesia in 12 to 16% by mass. In addition, the "aluminum titanate forming raw material" means a raw material which becomes aluminum titanate by firing, and is a ceramic raw material with which a "predetermined raw material" is mixed so as to obtain a chemical composition of alumina in 56% by mass and titania in 44% by mass. In addition, the "zirconia forming raw material" means a raw material which becomes zirconia by firing, and is a ceramic raw material with which a "predetermined raw material" is mixed so as to obtain zirconia in 100% by mass. Examples of the "predetermined raw material" include metal silicon, a carbon source raw material, talc, kaolin, an alumina source raw material, silica, titania, and zirconia. The "carbon source raw material" means carbon black, graphite, a phenol resin serving as a carbon source by pyrolysis, or the like. The "alumina source raw material" means a raw material for forming an oxide by firing, such as aluminum oxide, aluminum hydroxide, or boehmite. In addition, the raw material 11 may contain such a ceramic raw material as described above and a metal. Examples of the raw material 11 include a raw material containing silicon carbide in 80% by mass and metal silicon in 20% by mass.

In the ceramic formed body extrusion method according to an aspect of the present invention, the aspect ratio of the particle 10 is two or more and less than 300. The ceramic formed body 1 formed by using the raw material 11 containing the particle 10 of a high aspect ratio can be subjected to extrusion, and the particle 10 is easily oriented such that the length direction of the particle 10 is approximately parallel to the thickness direction of the formed portion 2.

In the ceramic formed body extrusion method according to an aspect of the present invention, examples of the particle 10 of a high aspect ratio include a pore former and a ceramic raw material. The kind of the pore former is not particularly limited, but preferable examples thereof include a carbon fiber, cellulose, graphite, nylon, and rayon. The kind of the ceramic raw material is not particularly limited, but preferable examples thereof include silicon carbide, cordierite, alumina, and zirconia. The particle 10 of a high aspect ratio is preferably a pore former. When a ceramic formed body formed by the method according to an aspect of the present invention contains a pore former as the particle 10, by burning the pore former by firing, a ceramic porous body which has a pore of a high aspect ratio and in which the pore is oriented such that a length direction of the pore is approximately parallel to a thickness direction of the formed portion 2 is obtained. The pore former is burned by firing the ceramic formed body 1, and a pore having almost the same shape as the pore former is formed in a portion where the pore former was present. In addition, even when the particle of a high aspect ratio is not burned by firing a ceramic raw material or the like, a ceramic porous body in which a pore of a high aspect ratio is formed in a gap between first particles after firing and the pore is oriented such that a length direction of the pore is approximately parallel to a thickness direction of the formed portion is obtained.

In the ceramic formed body extrusion method according to an aspect of the present invention, preferably, the raw material contains a second particle having an aspect ratio of less than two, and the second particle is a pore former. Because the raw material further contains the second particle, an increase in a pressure loss with soot in a ceramic porous body obtained by firing a ceramic formed body can be suppressed.

The particle diameter of the second particle is preferably from 0.2 to 20 μm, and more preferably from 5 to 15 μm. By setting the particle diameter of the second particle within the above range, the porosity on a surface of a partition wall is increased, and the pressure loss with soot is therefore reduced. When the particle diameter of the second particle is less than the above lower limit value, the porosity on a surface of a partition wall is lowered, and the pressure loss with soot may be therefore increased. When the particle diameter of the second particle is more than the above upper limit value, the pore diameter on a surface of a partition wall is increased, soot may therefore penetrate an inside of the partition wall, and the pressure loss with soot may be increased.

Here, the "particle diameter of second particle" herein is a value measured as follows. A maximum length and a maximum vertical length were measured using a flow type particle image analyzer ("FPIA-3000S (trade name)" manufactured by Sysmex Corporation), and an average value of the maximum length and the maximum vertical length was used as a particle diameter.

The kind of the second particle is not particularly limited, but preferable examples thereof include starch, carbon black, and an acrylic resin. When a ceramic formed body formed by the method according to an aspect of the present invention contains the second particle, the ceramic formed body has a pore of the second particle by burning the second particle by firing, and the pore further increases permeation performance of fluid in a flow channel formed by a pore of a high aspect ratio. As a result, the pressure loss is further reduced. Specifically, formation of a pore of a high aspect ratio may be difficult at a predetermined orientation degree (0 to 53°) in a surface region of a partition wall. Also in this case, by further adding the second particle, a pore of the second particle is formed in the entire partition wall (particularly in a surface region), and permeation performance of fluid in the partition wall can be further improved.

A ratio of the addition amount of the second particle with respect to the total addition amount of the first particle and the second particle is preferably from 0 to 50% by volume, more preferably from 6 to 29% by volume, and particularly preferably from 14 to 29% by volume. By setting the ratio within the above range, an increase in a pressure loss with soot in a ceramic porous body obtained after firing can be further suppressed. When the ratio is more than the above upper limit value, the orientation degree of a pore of a high aspect ratio is lowered, and the pressure loss with soot may be therefore increased.

In the ceramic formed body extrusion method according to an aspect of the present invention, the raw material for forming is preferably formed by adding and mixing a dispersing medium, an organic binder, an inorganic binder, a surfactant, a dispersing agent, or the like to such a ceramic raw material and a pore former as described above, and kneading the resulting mixture with a kneader, a vacuum pugmill, or the like.

The shape of a ceramic formed body formed by the ceramic formed body extrusion method according to an aspect of the present invention is not particularly limited except that the shape has a wall-shaped or plate-shaped formed portion. However, one of preferable examples thereof is a honeycomb-shaped ceramic formed body. The honeycomb-shaped ceramic formed body is specifically a ceramic formed body having partition walls for defining a plurality of cells. A honeycomb-shaped ceramic porous body obtained by firing the ceramic formed body can be used suitably for a filter such as DPF, a catalyst carrier, or the like. In such a honeycomb-shaped ceramic formed body, the partition wall is a "wall-shaped or plate-shaped formed portion".

Figure 5:
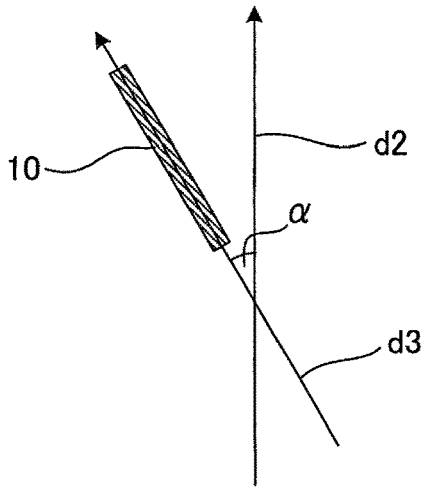
FIG. 5 is an explanatory diagram illustrating a method for measuring an orientation degree of a first particle.

(2) Ceramic Formed Body:

The ceramic formed body according to an aspect of the present invention is obtained by the ceramic formed body extrusion method according to an aspect of the present invention, described above. That is, as illustrated in FIG. 1, the ceramic formed body according to an aspect of the present invention has the wall-shaped or plate-shaped formed portion 2, and contains a particle (first particle) having an aspect ratio of two or more and less than 300. In addition, this ceramic formed body has the following characteristics in a dry state. That is, as illustrated in FIG. 5, among three regions obtained by equally dividing a cut surface 12 obtained by cutting the formed portion 2 in a thickness direction d2 thereof into three parts in the thickness direction d2, the orientation degree of the first particle in a region (hereinafter, referred to as "central region") 13 located in the center in the thickness direction d2 is from 0 to 53°. By firing the ceramic formed body in which the first particle such as a pore former has such an orientation degree, a ceramic porous body having many pores communicating in the thickness direction of the formed portion 2 is obtained, and high permeation performance is obtained easily.

In the present invention, the "orientation degree of the first particle" means a value obtained by measuring an angle α formed by the thickness direction d2 of the formed portion 2 and a maximum diameter direction d3 of the particle 10, illustrated in FIG. 5 for particles of a high aspect ratio present in the central region 13 by the following method, and calculating an average value of measurement values obtained. Here, the thickness direction d2 of the formed portion 2 is perpendicular to the extrusion direction d1 when a ceramic formed body is subjected to extrusion. The angle α can be measured using an image analysis software from an SEM image (reflected electron image) obtained by SEM (scanning electron microscope) observation of the central region 13. Examples of the image analysis software include an image analysis software "Image-Pro Plus 7.0J (trade name)" manufactured by Media Cybernetics, Inc.

More specifically, the method for measuring the orientation degree of the first particle herein is as follows when (1) the thickness of the wall-shaped or plate-shaped formed portion (partition wall in a case of a honeycomb-shaped structure) is more than 300 μm. First, a reflected electron image is imaged in a central region (imaging region) in a thickness direction of a formed portion (for example, a partition wall) using SEM (scanning electron microscope). In this case, an imaging magnification of 200 (1280×960 pixels) is used. Subsequently, a range of 100 μm in a thickness direction×400 μm in a direction perpendicular to the thickness direction is selected in an imaged image to be used as an evaluation field of view. Subsequently, in this evaluation field of view, median processing (option: kernel size of 7×7, one time) is performed with a 2D filter, and binarization processing (that is, processing to make a particle of a high aspect ratio white and to make the other materials black) is performed. Subsequently, the portion of a particle of a high aspect ratio (portion recognized as a particle of a high aspect ratio on the image) is subjected to thinning processing with a 2D filter to obtain a primarily processed image. Subsequently, the image which has been subjected to thinning processing (primarily processed image) is subjected to Y-shaped or cross-shaped processing with a 2D filter with a branch/end point filter to obtain a secondarily processed image. Subsequently, the secondarily processed image is subtracted from the primarily processed image to obtain an evaluation image. All the particles corresponding to the first particle 10 in this evaluation image are selected, the angles thereof are measured, and an average value of the angles is determined. This measurement is performed in 50 fields of view, and an average value thereof is determined. This is referred to as the "orientation degree of the first particle".

In addition, the method for measuring the orientation degree of the first particle herein is specifically as follows when (2) the thickness of the wall-shaped or plate-shaped formed portion (partition wall in a case of a honeycomb-shaped structure) is 300 μm or less. First, a reflected electron image is imaged in a central region obtained by equally dividing a formed portion (for example, a partition wall) into three parts in a thickness direction using SEM (scanning electron microscope). In this case, an imaging magnification of 200 (1280×960 pixels) is used. Subsequently, a range of a length obtained by equally dividing a formed portion into three parts in a thickness direction×400 m in a direction perpendicular to the thickness direction is selected in an imaged image to be used as an evaluation field of view. Subsequently, in this evaluation field of view, median processing (option: kernel size of 7×7, one time) is performed with a 2D filter, and binarization processing (that is, processing to make a particle of a high aspect ratio white and to make the other materials black) is performed. Subsequently, the portion of a particle of a high aspect ratio (portion recognized as a particle of a high aspect ratio on the image) is subjected to thinning processing to obtain a primarily processed image. Subsequently, the image which has been subjected to thinning processing (primarily processed image) is subjected to Y-shaped or cross-shaped processing with a 2D filter with a branch/end point filter to obtain a secondarily processed image. Subsequently, the secondarily processed image is subtracted from the primarily processed image to obtain an evaluation image. All the particles corresponding to the first particle 10 in this evaluation image are selected, the angles thereof are measured, and an average value of the angles is determined. This measurement is performed in 50 fields of view, and an average value thereof is determined. This is referred to as the "orientation degree of the first particle".

Incidentally, when the particle of a high aspect ratio is a pore former, the orientation degree of the particle (pore former) can be also measured from a ceramic porous body obtained by firing a ceramic formed body in addition to a ceramic formed body in a dry state. Specifically, among three regions obtained by equally dividing a cut surface obtained by cutting a wall-shaped or plate-shaped portion of a ceramic porous body along a thickness direction thereof into three parts in the thickness direction of the portion, the orientation degree of a pore in a region located in the center in the thickness direction of the portion is measured in place of the orientation degree of the first particle by the above measurement method. A pore of the ceramic porous body is formed by burning the pore former contained in the ceramic formed body by firing the ceramic formed body. Therefore, orientation of a pore in the ceramic porous body is approximately equal to orientation of a pore former contained in the ceramic formed body. By measuring the orientation degree of the pore, the orientation degree of the pore former can be measured indirectly.

In the ceramic formed body according to an aspect of the present invention, in which the orientation degree of the particle of a high aspect ratio, measured in this way is from 0 to 53°, many particles of a high aspect ratio are oriented such that a length direction thereof is approximately parallel to a thickness direction of the wall-shaped or plate-shaped formed portion. Therefore, by firing the ceramic formed body according to an aspect of the present invention, a ceramic porous body which has a pore of a high aspect ratio and in which the pore is oriented such that a length direction of the pore is approximately parallel to a thickness direction of the formed portion is obtained. Such a ceramic porous body has many pores communicating in the thickness direction of the formed portion. Therefore, when the ceramic porous body is used as a filter, a permeation path of fluid such as gas is short, high permeation performance is obtained, and a pressure loss with soot is reduced consequently.

The particle of a high aspect ratio contained in the ceramic formed body according to an aspect of the present invention is preferably a pore former. The kind of the pore former is not particularly limited, but preferable examples thereof include a carbon fiber, cellulose, graphite, nylon, and rayon. The ceramic formed body according to an aspect of the present invention preferably contains at least one ceramic raw material selected from the group consisting of silicon carbide, cordierite, aluminum titanate, zirconia, aluminum oxide, a silicon carbide forming raw material, a cordierite forming raw material, an aluminum titanate forming raw material, and a zirconia forming raw material, and more preferably contains at least one ceramic raw material selected from the group consisting of silicon carbide, cordierite, aluminum titanate, aluminum oxide, a silicon carbide forming raw material, a cordierite forming raw material, and an aluminum titanate forming raw material. In addition, the ceramic formed body according to an aspect of the present invention may contain a dispersing medium, an organic binder, an inorganic binder, a dispersing agent, or the like in addition to such a ceramic raw material and a particle of a high aspect ratio as described above.

In the ceramic formed body according to an aspect of the present invention, the length of the particle of a high aspect ratio is preferably 50% or less of the thickness of the formed portion, and more preferably 47% or less thereof. By setting the length of the particle of a high aspect ratio to such a value, a ceramic formed body having an orientation degree of 0 to 53° is obtained easily.

In the ceramic formed body according to an aspect of the present invention, the content of the particle of a high aspect ratio is preferably 70% by volume or less, more preferably 45% by volume or less, and still more preferably 35% by volume or less with respect to the whole of the raw material constituting the ceramic formed body. By setting the content of the particle of a high aspect ratio to such a value, a ceramic formed body having an orientation degree of 0 to 53° is obtained easily. Note that the lower limit value of the addition amount of the particle of a high aspect ratio is preferably 1% by volume with respect to the whole of the raw material.

The ceramic formed body according to an aspect of the present invention can further contain a second particle having an aspect ratio of less than two. Because the ceramic formed body further contains the second particle, an increase in a pressure loss with soot in a ceramic porous body obtained by firing the ceramic formed body can be suppressed.

The particle diameter of the second particle is preferably from 0.2 to 20 μm, and more preferably from 5 to 15 μm. By setting the particle diameter of the second particle within the above range, the porosity on a surface of a partition wall is increased, and the pressure loss with soot is therefore reduced. When the particle diameter of the second particle is less than the above lower limit value, the porosity on a surface of a partition wall is lowered, and the pressure loss with soot may be therefore increased. When the particle diameter of the second particle is more than the above upper limit value, the pore diameter on a surface of a partition wall is increased, soot may therefore penetrate an inside of the partition wall, and the pressure loss with soot may be increased.

The kind of the second particle is not particularly limited, but preferable examples thereof include starch, carbon black, and an acrylic resin.

A ratio of the addition amount of the second particle with respect to the total addition amount of the first particle and the second particle is preferably from 0 to 50% by volume, more preferably from 6 to 29% by volume, and particularly preferably from 14 to 29% by volume. By setting the ratio within the above range, an increase in a pressure loss with soot in a ceramic porous body obtained after firing can be further suppressed. When the ratio is more than the above upper limit value, the orientation degree of a pore of a high aspect ratio is lowered, and the pressure loss with soot may be therefore increased.

The shape of the ceramic formed body formed according to an aspect of the present invention is not particularly limited except that the shape has a wall-shaped or plate-shaped formed portion. However, one of preferable examples thereof is a honeycomb-shaped ceramic formed body. The honeycomb-shaped ceramic formed body is specifically a ceramic formed body having partition walls for defining a plurality of cells. A honeycomb-shaped ceramic porous body obtained by firing the ceramic formed body can be used suitably for a filter such as DPF, a catalyst carrier, or the like. In such a honeycomb-shaped ceramic formed body, the partition wall is a "wall-shaped or plate-shaped formed portion".

(3) Ceramic Porous Body:

The ceramic porous body according to an aspect of the present invention has partition walls having a plurality of pores for defining a plurality of cells. In the ceramic porous body according to an aspect of the present invention, among three regions obtained by equally dividing a cut surface obtained by cutting the ceramic porous body in a thickness direction of the partition wall into three parts in the thickness direction of the partition wall, the orientation degree of a pore in a central region located in the center in the thickness direction of the partition wall is from 0 to 53°. In addition, in the ceramic porous body according to an aspect of the present invention, among the three regions, a difference between the porosity in a surface region outside the central region and the porosity of the partition walls is from 0 to 11%.

In the ceramic porous body according to an aspect of the present invention, the orientation degree of a pore in a central region of the partition wall is from 0 to 530 as described above, more preferably from 0 to 430, and still more preferably from 0 to 28°. By setting the orientation degree within such a range, high permeation performance of fluid is easily obtained. Note that the orientation degree of a pore is a value calculated by measuring the orientation degree of a pore in place of that of the first particle by a method similar to the above method for measuring the orientation degree of the first particle.

As described above, in the ceramic porous body according to an aspect of the present invention, a difference in the porosity between a surface region of a partition wall thereof and the entire partition wall (value calculated with formula: porosity of the entire partition wall—porosity in a surface region of a partition wall) is from 0 to 11%, and preferably from 0 to 5%. By setting the difference within such a range, higher permeation performance of fluid is obtained.

Note that the porosity in a surface region of a partition wall is determined by image analysis. Specifically, the porosity in the surface region of the partition wall is determined as follows.

(1) When the thickness of the partition wall is more than 300 μm, measurement is performed as follows. First, a reflected electron image is imaged in a region of 100 μm or less in a thickness direction from the surface of the partition wall using SEM (scanning electron microscope). In this case, an imaging magnification of 200 (1280×960 pixels) is used. The porosity is calculated using the image analysis software "Image-Pro Plus 7.0J (trade name)" manufactured by Media Cybernetics, Inc. Subsequently, a range of 100 μm in a thickness direction×400 μm in a direction perpendicular to the thickness direction is selected in an imaged image to be used as an evaluation field of view. Subsequently, in this evaluation field of view, median processing (option: kernel size of 7×7, one time) is performed with a 2D filter, and binarization processing (that is, processing to make a pore white and to make a ceramic black) is performed. Subsequently, an area ratio (pore/ceramic) between a pore (white portion) and a ceramic (black portion) in the image which has been subjected to binarization processing is measured. This measurement is performed in 50 fields of view, and an average value thereof is determined. This value is used as a porosity in a surface region of a partition wall.

(2) When the thickness of the partition wall is 300 μm or less, measurement is performed as follows. First, a reflected electron image is imaged in a region other than the central region obtained by equally dividing a partition wall into three parts (portion in contact with a surface of the partition wall) in a thickness direction using SEM (scanning electron microscope). In this case, an imaging magnification of 200 (1280×960 pixels) is used. The porosity is calculated using the image analysis software "Image-Pro Plus 7.0J (trade name)" manufactured by Media Cybernetics, Inc. Subsequently, a range of a length obtained by equally dividing a partition wall into three parts in a thickness direction×400 μm in a direction perpendicular to the thickness direction is selected in an imaged image to be used as an evaluation field of view. Subsequently, in this evaluation field of view, median processing (option: kernel size of 7×7, one time) is performed with a 2D filter, and binarization processing (that is, processing to make a pore white and to make a ceramic black) is performed. Subsequently, an area ratio (pore/ ceramic) between a pore (white portion) and a ceramic (black portion) in the image which has been subjected to binarization processing is measured. This measurement is performed in 50 fields of view, and an average value thereof is determined. This value is used as a porosity in a surface region of a partition wall.

The porosity of a partition wall (the entire partition wall) in the ceramic porous body according to an aspect of the present invention is preferably 65% or less, and more preferably from 25 to 45%. By setting the porosity within such a range, both a high strength of the ceramic porous body and a low pressure loss with soot are obtained. When the porosity of partition walls is more than the above upper limit value, the strength of the ceramic porous body may be lowered. Note that the "porosity of partition walls" is a value measured in accordance with JIS R 1634 by an Archimedes method.

The ceramic porous body according to an aspect of the present invention can be obtained, for example, by firing the ceramic formed body according to an aspect of the present invention by a conventionally known method as described above. The shape of the ceramic porous body is not particularly limited, but can be a honeycomb shape. Particularly, a honeycomb-shaped ceramic porous body can be obtained by firing the above honeycomb-shaped ceramic formed body.

Figure 6:
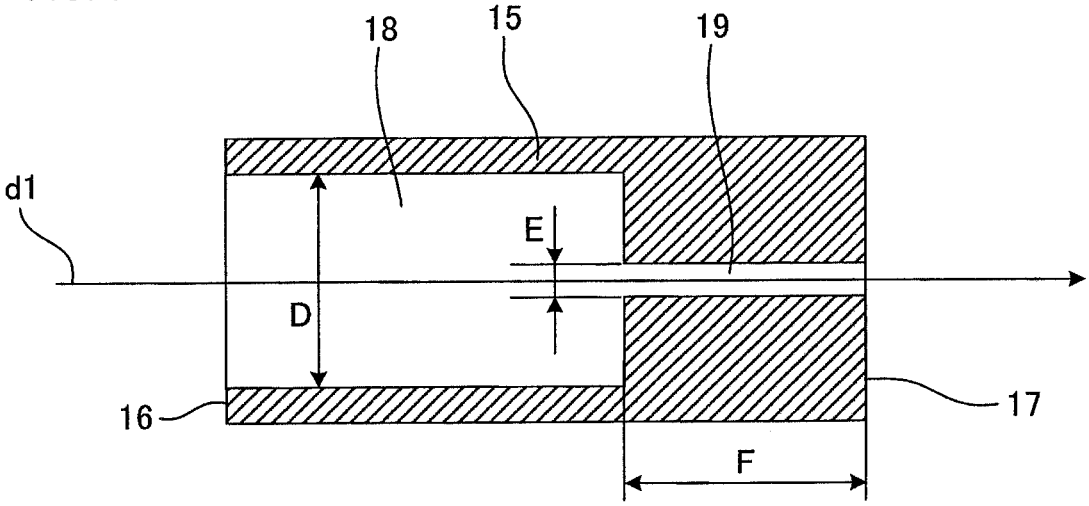
FIG. 6 is a cross-sectional view schematically illustrating an extrusion die used in a conventionally general ceramic formed body extrusion method.

(4) Conventional Ceramic Formed Body Extrusion Method:

For comparison with the ceramic formed body extrusion method according to an aspect of the present invention, a conventional general ceramic formed body extrusion method will be described by exemplifying a case where a ceramic formed body formed by the method is a plate-shaped (sheet-shaped) ceramic formed body. In the conventional ceramic formed body extrusion method, an extrusion die 15 illustrated in FIG. 6 is used. The extrusion die 15 has a raw material supply surface 16 and a raw material forming surface 17 opposite to the raw material supply surface 16. At least one introduction hole 18 for introducing a raw material for forming is provided in the raw material supply surface 16. On the other hand, a slit (forming groove) 19 for extrusion of a plate-shaped (sheet-shaped) ceramic formed body from a raw material is provided in the raw material forming surface 17. The introduction hole 18 communicates with the slit 19 in the extrusion die 15. The slit 19 is constituted so as to have a uniform width E in the extrusion direction d1 in extrusion.

Figure 7:
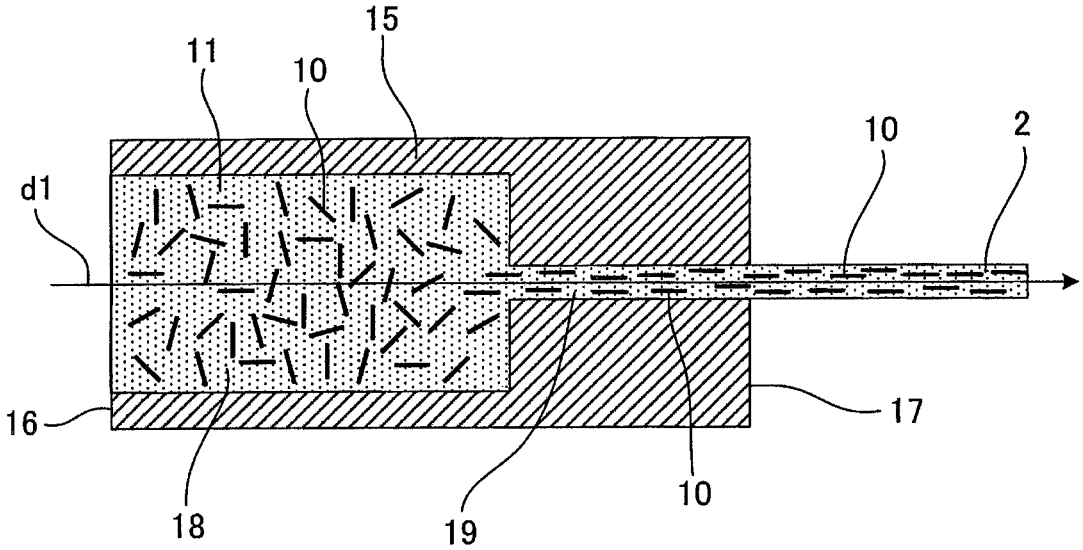
FIG. 7 is an explanatory diagram schematically illustrating the conventionally general ceramic formed body extrusion method.

In the conventional ceramic formed body extrusion method, as illustrated in FIG. 7, the raw material 11 is introduced from the introduction hole 18 of the extrusion die 15, and the raw material 11 is extruded so as to pass through the slit 19. The extruded raw material 11 which has passed through the slit 19 becomes the formed portion 2 having a thickness corresponding to the width E of the slit 19, is extruded into an outside of the extrusion die 15 from the slit 19, and becomes a ceramic formed body having the formed portion 2.

In such a conventional ceramic formed body extrusion method, the width E of the slit is uniform in the extrusion direction d1. Therefore, as illustrated in FIG. 7, the raw material 11 which has flowed in the slit 19 does not change a flowing direction thereof, but goes straight in the extrusion direction d1. Therefore, in a case where the raw material 11 contains the particle 10 of a high aspect ratio, when the raw material 11 flows in the slit 19 from the introduction hole 18, the particle 10 is oriented such that a length direction thereof (maximum diameter direction) is approximately parallel to the extrusion direction d1. Then, while the particle 10 maintains such an oriented state, the raw material 11 becomes a formed portion having a thickness corresponding to the width E of the slit 19, and is extruded into an outside of the extrusion die 15 from the slit 19.

In this way, in the conventional ceramic formed body extrusion method, the particle 10 of a high aspect ratio contained in the raw material 11 which has flowed in the slit 19 is extruded into an outside of the extrusion die 15 without changing an orientation direction in the middle of the slit 19. Therefore, a ceramic formed body formed by the conventional ceramic formed body extrusion method using a raw material containing a particle of a high aspect ratio contains a particle of a high aspect ratio, but the particle is oriented such that a length direction of the particle is approximately parallel to an extrusion direction thereof. That is, by the conventional ceramic formed body extrusion method, it is not possible to form a ceramic formed body which contains a particle of a high aspect ratio and in which the particle is oriented such that a length direction of the particle is approximately parallel to a thickness direction of a formed portion.

EXAMPLES

Hereinafter, the present invention will be described in more detail based on Examples, but the present invention is not limited to the Examples.

Example 1

Alumina powder was used as a ceramic raw material. A pore former, a binder, and a dispersing agent were added to the ceramic raw material to obtain a raw material for forming. By adding water to this raw material and kneading the resulting mixture, a kneaded material having a hardness of 10 was obtained. As the pore former, a carbon fiber having a length (maximum diameter) of 200 μm, a thickness (width perpendicular to maximum diameter) of 12 μm, and an aspect ratio of 17 was used. As the binder, hydroxypropoxyl methylcellulose was used. As the dispersing agent, a polyacrylate was used. The addition amount of the pore former was 35% by volume with respect to the whole of the raw material. The hardness of the kneaded material was measured with an NGK clay hardness tester (manufactured by NGK Insulators, Ltd.) (hereinafter, similarly in Examples 2 to 14).

The resulting kneaded material was subjected to extrusion using an extrusion die to obtain a plate-shaped (sheet-shaped) ceramic formed body. As the extrusion die, a die having the structure illustrated in FIG. 2 was used. The width A of the slit former stage unit in the extrusion die was 0.3 mm. The width B of the slit latter stage unit was 8 mm. The length C of the slit latter stage unit in the extrusion direction was 13 mm.

The resulting ceramic formed body was dried with a microwave and hot air, and then was degreased at about 800° C. in an atmospheric environment. Furthermore, the ceramic formed body after degreasing was fired at about 1500° C. in an atmospheric environment to obtain a plate-shaped (sheet-shaped) ceramic porous body constituted by alumina.

Figure 8:
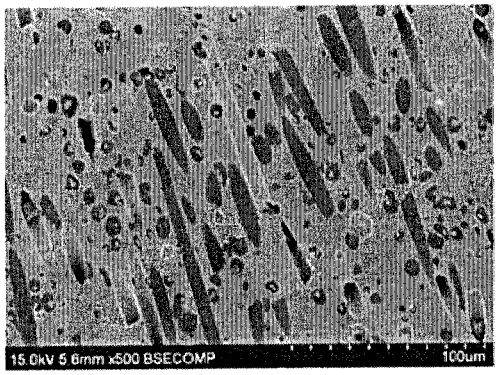
FIG. 8 is a photograph of an SEM (scanning electron microscope) image illustrating a fine structure of a central region of a ceramic porous body obtained in Example 1.

The orientation degree of a pore in the resulting ceramic porous body (substantially the same as the orientation degree of a pore former) was measured by the above method, and Table 2 indicates a result thereof. In addition, FIG. 8 illustrates a photograph of an SEM (scanning electron microscope) image illustrating a fine structure of a central region of the resulting ceramic porous body. In the SEM image illustrated in FIG. 8, dark color portions are pores formed by burning the pore former.

In addition, the "pressure loss with soot" was evaluated for a plate-shaped (sheet-shaped) ceramic porous body. Table 2 indicates an evaluation result thereof.

Note that the porosity of partition walls of this ceramic porous body (indicated as "entire porosity" in Tables 2 and 3) was 26%. The porosity of partition walls of the ceramic porous body was measured in accordance with JIS R 1634 by an Archimedes method. The porosity in a surface region was 17%. Note that the "porosity in a surface region" was obtained by the above image analysis with a scanning electron microscope.

[Pressure loss with soot] A pressure loss with soot (KPa/mm) for the prepared ceramic porous body was measured as follows. Note that the pressure loss with soot is a difference (P2−P1) between a pressure loss (P1) without accumulation of soot and a pressure loss (P2) after accumulation of soot.

Specifically, first, air of 377 $mm^3$/sec was caused to flow while soot was not trapped, and a pressure difference (pressure loss (P1)) between the front part and the rear part of a plate-shaped ceramic porous body (vertical length: 30 mm, horizontal length: 30 mm, thickness: 0.3 mm) was measured. Subsequently, soot generated by a soot generator (manufactured by Tokyo Dylec Corp., "CAST2") was diluted with air of 30 $m^3$/min, this mixed gas was caused to pass through the plate-shaped ceramic porous body for 2700 seconds, and the soot was accumulated on the plate-shaped ceramic porous body. Thereafter, air of 377 $mm^3$/sec was caused to flow through the plate-shaped ceramic porous body while soot was trapped, and a pressure difference (pressure loss (P2)) at this time was measured. Thereafter, a pressure loss with soot was calculated using formula: P2−P1. Note that the plate-shaped ceramic porous body was disposed such that a gas flowed in parallel to a thickness direction of a partition wall when the gas flows.

Example 2

A plate-shaped (sheet-shaped) ceramic porous body was obtained in a similar manner to Example 1 except that the addition amount of the pore former was 45% by volume with respect to the whole of the raw material. The orientation degree of a pore in the resulting ceramic porous body (substantially the same as the orientation degree of a pore former) was measured by the above method, and Table 2 indicates a result thereof.

In addition, the "porosity of partition walls" and the "porosity in a surface region" were determined for the plate-shaped ceramic porous body. The "pressure loss with soot" was evaluated for this plate-shaped ceramic porous body in a similar manner to Example 1. Table 2 indicates an evaluation result thereof.

Example 3

By mixing 75 parts by mass of silicon carbide powder, 35 parts by mass of metal silicon powder, 6.6 parts by mass of talc powder, 4.4 parts by mass of alumina powder, 13.4 parts by mass of kaolin powder, and 1.0 part by mass of montmorillonite powder, a ceramic raw material was obtained. A pore former and a binder were added to the resulting ceramic raw material to obtain a raw material for forming. By adding water to this raw material and kneading the resulting mixture, a kneaded material having a hardness of 12 was obtained. As the pore former, cellulose having a length (maximum diameter) of 140 μm, a thickness (width perpendicular to maximum diameter) of 15 μm, and an aspect ratio of 9 was used. As the binder, hydroxypropoxyl methylcellulose was used. The addition amount of the pore former was 13% by volume with respect to the whole of the raw material. The hardness of the kneaded material was measured with an NGK clay hardness tester.

The resulting raw material was subjected to extrusion using an extrusion die to obtain a plate-shaped (sheet-shaped) ceramic formed body. As the extrusion die, a die having the structure illustrated in FIG. 2 was used. The width A of the slit former stage unit in the extrusion die was 0.1 mm. The width B of the slit latter stage unit was 0.3 mm. The length C of the slit latter stage unit in the extrusion direction was 3 mm.

The resulting ceramic formed body was dried with a microwave and hot air, and then was degreased at about 450° C. in an atmospheric environment. Thereafter, the orientation degree of a particle of a high aspect ratio (pore former) was measured by the above method, and Table 2 indicates a result thereof.

In addition, the "porosity of partition walls" and the "porosity in a surface region" were determined for the plate-shaped ceramic porous body. The "pressure loss with soot" was evaluated for this plate-shaped ceramic porous body in a similar manner to Example 1. Table 2 indicates an evaluation result thereof.

Example 4

A plate-shaped (sheet-shaped) ceramic formed body was obtained in a similar manner to Example 3 except that graphite having a length (maximum diameter) of 150 μm, a thickness (width perpendicular to maximum diameter) of 10 μm, and an aspect ratio of 15 was used as a pore former. The resulting ceramic formed body was dried with a microwave and hot air, and then was degreased at about 800° C. in an atmospheric environment. Thereafter, the orientation degree of a particle of a high aspect ratio (pore former) was measured by the above method, and Table 2 indicates a result thereof.

In addition, the "porosity of partition walls" and the "porosity in a surface region" were determined for the plate-shaped ceramic porous body. The "pressure loss with soot" was evaluated for this plate-shaped ceramic porous body in a similar manner to Example 1. Table 2 indicates an evaluation result thereof.

Example 5

By mixing 90 parts by mass of silicon carbide powder, 35 parts by mass of metal silicon powder, 6.6 parts by mass of talc powder, 4.4 parts by mass of alumina powder, 13.4 parts by mass of kaolin powder, and 1.0 part by mass of montmorillonite powder, a ceramic raw material was obtained. A particle of a high aspect ratio, a spherical pore former, and a binder were added to the resulting ceramic raw material to obtain a raw material for forming. By adding water to this raw material and kneading the resulting mixture, a kneaded material having a hardness of 11 was obtained. As the particle of a high aspect ratio, silicon carbide having a length (maximum diameter) of 21 μm, a thickness (width perpendicular to maximum diameter) of 10 μm, and an aspect ratio of 2 was used. As the spherical pore former, starch was used. As the binder, hydroxypropoxyl methylcellulose was used. The addition amount of the particle of a high aspect ratio was 37% by volume with respect to the whole of the raw material. The hardness of the kneaded material was measured with an NGK clay hardness tester. A plate-shaped (sheet-shaped) ceramic formed body was subjected to extrusion in a similar manner to Example 3 using this kneaded material. The resulting ceramic formed body was dried with a microwave and hot air, and then was degreased at about 450° C. in an atmospheric environment. Thereafter, the orientation degree of a particle (silicon carbide) of a high aspect ratio was measured by the above method, and Table 2 indicates a result thereof.

Examples 6 to 15

A plate-shaped ceramic porous body was prepared in a similar manner to Example 1 except that the raw materials indicated in Table 1 were prepared and the extrusion dies indicated in Table 2 were used. The "porosity of partition walls" and the "porosity in a surface region" were determined for the prepared plate-shaped ceramic porous bodies in a similar manner to Example 1. In addition, the "pressure loss with soot" was evaluated for these plate-shaped ceramic porous bodies in a similar manner to Example 1. Table 2 indicates an evaluation result thereof.

In Examples 5 to 13 and 15, a raw material obtained by further blending a second particle having an aspect ratio of less than two (indicated in the column of "particle Y of a low aspect ratio" in Table 1) in addition to a first particle having an aspect ratio of two or more and less than 300 (indicated in the column of "particle X of a high aspect ratio" in Table 1) was used.

The ceramic porous bodies in Examples 5 to 13 and 15 had a better evaluation result of the "pressure loss with soot" than a ceramic porous body prepared using only the first particle of the first particle and the second particle.

Comparative Example 1

Figure 9:
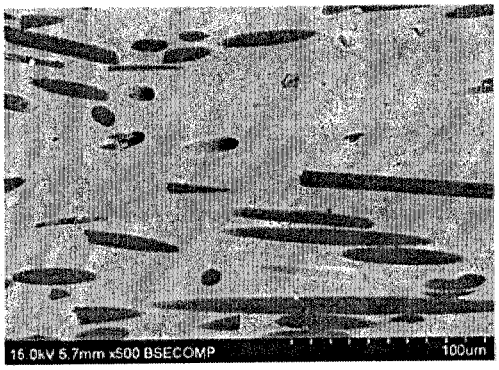
FIG. 9 is a photograph of an SEM (scanning electron microscope) image illustrating a fine structure of a central region of a ceramic porous body obtained in Comparative Example 1.

A plate-shaped (sheet-shaped) ceramic porous body was obtained in a similar manner to Example 1 except that an extrusion die having a conventional structure illustrated in FIG. 6 was used. The diameter D of the introduction hole in the extrusion die was 25 mm. The width E of the slit was 0.3 mm. The length F of the slit in the extrusion direction was 3 mm. The orientation degree of a pore in the resulting ceramic porous body (substantially the same as the orientation degree of a pore former) was measured by the above method, and Table 2 indicates a result thereof. In addition, FIG. 9 illustrates a photograph of an SEM (scanning electron microscope) image illustrating a fine structure of a central region of the resulting ceramic porous body. In the SEM image illustrated in FIG. 9, dark color portions are pores formed by burning a pore former.

In addition, the "porosity of partition walls" and the "porosity in a surface region" were determined for the plate-shaped ceramic porous body. The "pressure loss with soot" was evaluated for this plate-shaped ceramic porous body in a similar manner to Example 1. Table 3 indicates an evaluation result thereof. The "porosity of partition walls" and the "porosity in a surface region" were determined, and the "pressure loss with soot" was evaluated similarly for each of the plate-ceramic porous bodies in Comparative Examples 2 to 5.

Comparative Example 2

A plate-shaped (sheet-shaped) ceramic porous body was obtained in a similar manner to Example 2 except that an extrusion die having a conventional structure illustrated in FIG. 6 was used. The diameter D of the introduction hole in the extrusion die was 25 mm. The width E of the slit was 0.3 mm. The length F of the slit in the extrusion direction was 3 mm. The orientation degree of a pore in the resulting ceramic porous body (substantially the same as the orientation degree of a pore former) was measured by the above method, and Table 3 indicates a result thereof.

Comparative Example 3

A plate-shaped (sheet-shaped) ceramic formed body was obtained in a similar manner to Example 3 except that an extrusion die having a conventional structure illustrated in FIG. 6 was used. The diameter D of the introduction hole in the extrusion die was 25 mm. The width E of the slit was 0.3 mm. The length F of the slit in the extrusion direction was 3 mm. The resulting ceramic formed body was dried and degreased in a similar manner to Example 3. Thereafter, the orientation degree of a particle of a high aspect ratio (pore former) was measured by the above method, and Table 3 indicates a result thereof.

Comparative Example 4

A plate-shaped (sheet-shaped) ceramic formed body was obtained in a similar manner to Example 4 except that an extrusion die having a conventional structure illustrated in FIG. 6 was used. The diameter D of the introduction hole in the extrusion die was 25 mm. The width E of the slit was 0.3 mm. The length F of the slit in the extrusion direction was 3 mm. The resulting ceramic formed body was dried and degreased in a similar manner to Example 4. Thereafter, the orientation degree of a particle of a high aspect ratio (pore former) was measured by the above method, and Table 3 indicates a result thereof.

Comparative Example 5

A plate-shaped (sheet-shaped) ceramic formed body was obtained in a similar manner to Example 5 except that an extrusion die having a conventional structure illustrated in FIG. 6 was used. The diameter D of the introduction hole in the extrusion die was 25 mm. The width E of the slit was 0.3 mm. The length F of the slit in the extrusion direction was 3 mm. The resulting ceramic formed body was dried and degreased in a similar manner to Example 5. Thereafter, the orientation degree of a particle (silicon carbide) of a high aspect ratio was measured by the above method, and Table 3 indicates a result thereof.

Comparative Example 6

A kneaded material was obtained in a similar manner to Example 1 except that a carbon fiber having a length (maximum diameter) of 3000 μm, a thickness (width perpendicular to maximum diameter) of 10 μm, and an aspect ratio of 300 was used as a pore former. The resulting kneaded material was subjected to extrusion using an extrusion die similar to Example 3, and a trial to obtain a plate-shaped (sheet-shaped) ceramic formed body was performed. However, the kneaded material did not pass through the extrusion die, and forming was impossible. Table 2 indicates an evaluation result thereof.

Comparative Example 7

A plate-shaped ceramic porous body was prepared in a similar manner to Example 1 except that the raw material indicated in Table 1 was prepared and the extrusion die indicated in Table 2 was used. The "porosity of partition walls" and the "porosity in a surface region" were determined for the prepared plate-shaped ceramic porous bodies in a similar manner to Example 1. In addition, the "pressure loss with soot" was evaluated for these plate-shaped ceramic porous bodies in a similar manner to Example 1. Table 2 indicates an evaluation result thereof.

Comparative Example 8

A plate-shaped ceramic porous body was prepared in a similar manner to Example 1 except that the raw material indicated in Table 1 was prepared and the extrusion die indicated in Table 2 was used. The "porosity of partition walls" and the "porosity in a surface region" were determined for the prepared plate-shaped ceramic porous bodies in a similar manner to Example 1. In addition, the "pressure loss with soot" was evaluated for these plate-shaped ceramic porous bodies in a similar manner to Example 1. Table 2 indicates an evaluation result thereof.

TABLE 1

| | | particle X of high aspect ratio | | | | | particle Y of low aspect ratio | | | | ratio of addition amount | |
|---|---|---|---|---|---|---|---|---|---|---|---|---|
| | ceramic raw material | kind | length L (μm) | thick-ness (μm) | aspect ratio | addition amount (% by volume) | kind | particle diameter (μm) | aspect ratio | addition amount (% by volume) | (particle Y/ (particle X + particle Y)) (% by volume) | kneaded material hardness — |
| Example 1 | $Al_2O_3$ | carbon fiber | 200 | 12 | 17 | 35 | — | — | — | — | — | 10 |
| Example 2 | $Al_2O_3$ | carbon fiber | 200 | 12 | 17 | 45 | — | — | — | — | — | 10 |
| Example 3 | Si, SiC | cellulose | 140 | 15 | 9 | 13 | — | — | — | — | — | 12 |
| Example 4 | Si, SiC | graphite | 150 | 10 | 15 | 13 | — | — | — | — | — | 13 |
| Example 5 | Si, SiC | silicon carbide | 21 | 10 | 2 | 30 | starch | 10 | 1 | 13 | 30 | 11 |
| Example 6 | $Al_2O_3$ | carbon fiber | 200 | 12 | 17 | 30 | starch | 5 | 1 | 5 | 14 | 10 |
| Example 7 | $Al_2O_3$ | carbon fiber | 200 | 12 | 17 | 33 | starch | 5 | 1 | 2 | 6 | 10 |
| Example 8 | $Al_2O_3$ | carbon fiber | 200 | 12 | 17 | 25 | starch | 5 | 1 | 10 | 29 | 10 |
| Example 9 | $Al_2O_3$ | carbon fiber | 200 | 12 | 17 | 17.5 | starch | 5 | 1 | 17.5 | 50 | 11 |
| Example 10 | $Al_2O_3$ | carbon fiber | 200 | 12 | 17 | 30 | carbon black | 0.2 | 1 | 5 | 14 | 10 |
| Example 11 | $Al_2O_3$ | carbon fiber | 200 | 12 | 17 | 30 | starch | 15 | 1 | 5 | 14 | 10 |
| Example 12 | $Al_2O_3$ | carbon fiber | 200 | 12 | 17 | 30 | starch | 20 | 1 | 5 | 14 | 10 |
| Example 13 | Si, SiC | carbon fiber | 200 | 12 | 17 | 10 | starch | 5 | 1 | 3 | 23 | 10 |
| Example 14 | $Al_2O_3$ | carbon fiber | 200 | 12 | 17 | 70 | — | — | — | — | — | 10 |
| Comparative Example 1 | $Al_2O_3$ | carbon fiber | 200 | 12 | 17 | 35 | — | — | — | — | — | 10 |
| Comparative Example 2 | $Al_2O_3$ | carbon fiber | 200 | 12 | 17 | 45 | — | — | — | — | — | 10 |
| Comparative Example 3 | Si, SiC | cellulose | 140 | 15 | 9 | 13 | — | — | — | — | — | 12 |
| Comparative Example 4 | Si, SiC | graphite | 150 | 10 | 15 | 13 | — | — | — | — | — | 13 |
| Comparative Example 5 | Si, SiC | silicon carbide | 21 | 10 | 2 | 24 | — | — | — | — | — | 11 |
| Comparative Example 6 | $Al_2O_3$ | carbon fiber | 3000 | 10 | 300 | 35 | — | — | — | — | — | 10 |
| Comparative Example 7 | $Al_2O_3$ | — | — | — | — | — | starch | 20 | 1 | 35 | 100 | 11 |
| Comparative Example 8 | $Al_2O_3$ | carbon fiber | 30 | 10 | 3 | 35 | — | — | — | — | — | 10 |
| Example 15 | $Al_2O_3$ | carbon fiber | 200 | 12 | 17 | 60 | starch | 5 | 1 | 10 | 14 | 10 |

TABLE 2

| | extrusion die | | | | | | | | difference between entire | |
|---|---|---|---|---|---|---|---|---|---|---|
| | width A of slit former stage unit (mm) | length C of slit latter stage unit (mm) | width B of slit latter stage unit (mm) | B/A | L/B | entire porosity (%) | orientation degree (°) | porosity in surface region (%) | porosity and porosity in surface region (%) | pressure loss with soot (KPa/mm) |
| Example 1 | 0.3 | 13 | 8 | 26.7 | 0.03 | 26 | 28 | 17 | 9 | 9.7 |
| Example 2 | 0.3 | 13 | 8 | 26.7 | 0.03 | 30 | 34 | 19 | 11 | 9.4 |
| Example 3 | 0.1 | 3 | 0.3 | 3.0 | 0.47 | 31 | 30 | 24 | 7 | 9.8 |

TABLE 2-continued

| | extrusion die | | | | | | | | difference between entire | |
|---|---|---|---|---|---|---|---|---|---|---|
| | width A of slit former stage unit (mm) | length C of slit latter stage unit (mm) | width B of slit latter stage unit (mm) | B/A | L/B | entire porosity (%) | orientation degree (°) | porosity in surface region (%) | porosity and porosity in surface region (%) | pressure loss with soot (KPa/mm) |
| Example 4 | 0.1 | 3 | 0.3 | 3.0 | 0.50 | 29 | 53 | 24 | 5 | 10.0 |
| Example 5 | 0.1 | 3 | 0.3 | 3.0 | 0.07 | 32 | 42 | 23 | 9 | 9.9 |
| Example 6 | 0.3 | 13 | 8 | 26.7 | 0.03 | 27 | 32 | 21 | 6 | 8.5 |
| Example 7 | 0.3 | 13 | 8 | 26.7 | 0.03 | 27 | 30 | 19 | 8 | 9.2 |
| Example 8 | 0.3 | 13 | 8 | 26.7 | 0.03 | 26 | 38 | 23 | 3 | 8.7 |
| Example 9 | 0.3 | 13 | 8 | 26.7 | 0.03 | 27 | 47 | 25 | 2 | 9.8 |
| Example 10 | 0.3 | 13 | 8 | 26.7 | 0.03 | 25 | 30 | 18 | 7 | 9.6 |
| Example 11 | 0.3 | 13 | 8 | 26.7 | 0.03 | 27 | 38 | 24 | 3 | 9.3 |
| Example 12 | 0.3 | 13 | 8 | 26.7 | 0.03 | 28 | 49 | 27 | 1 | 9.6 |
| Example 13 | 0.3 | 13 | 8 | 26.7 | 0.03 | 32 | 43 | 28 | 4 | 9.3 |
| Example 14 | 0.3 | 13 | 8 | 26.7 | 0.03 | 65 | 51 | 60 | 5 | 6.3 |
| Comparative Example 6 | 0.1 | 3 | 0.3 | 3.0 | 10.00 | | | could not be formed | | |
| Comparative Example 7 | 0.3 | 13 | 8 | 26.7 | 0.03 | 26 | 60 | 24 | 2 | 11.4 |
| Comparative Example 8 | 0.3 | 13 | 8 | 26.7 | 0.03 | 26 | 53 | 13 | 13 | 12.5 |
| Example 15 | 0.3 | 13 | 8 | 26.7 | 0.03 | 65 | 53 | 64 | 1 | 5.9 |

TABLE 3

| | extrusion die | | | | | | | | difference between entire porosity and | |
|---|---|---|---|---|---|---|---|---|---|---|
| | diameter D of introduction hole (mm) | length F of slit (mm) | width E of slit (mm) | E/D | L/E | entire porosity (%) | orientation degree (°) | porosity in surface region (%) | porosity in surface region (%) | pressure loss with soot (KPa/mm) |
| Comparative Example 1 | 25 | 13 | 0.3 | 0.012 | 0.67 | 27 | 79 | 16 | 11 | 13.3 |
| Comparative Example 2 | 25 | 13 | 0.3 | 0.012 | 0.67 | 30 | 77 | 17 | 13 | 13.2 |
| Comparative Example 3 | 25 | 3 | 0.3 | 0.012 | 0.47 | 30 | 87 | 23 | 7 | 12.6 |
| Comparative Example 4 | 25 | 3 | 0.3 | 0.012 | 0.50 | 29 | 88 | 23 | 6 | 12.6 |
| Comparative Example 5 | 25 | 3 | 0.3 | 0.012 | 0.07 | 32 | 75 | 23 | 9 | 12.4 |

(Result)

As illustrated in Table 2, it is found that in Examples 1 to 15 using the extrusion method according to an aspect of the present invention, the orientation degree of a particle of a high aspect ratio was small and many particles of a high aspect ratio were oriented such that a length direction thereof was approximately parallel to a thickness direction of a formed portion of the ceramic formed body. On the other hand, as illustrated in Table 3, it is found that in Comparative Examples 1 to 5 using a conventional general extrusion method, the orientation degree of a particle of a high aspect ratio was large and many particles of a high aspect ratio were oriented such that a length direction thereof was approximately parallel to an extrusion direction thereof. Note that in Comparative Example 6 using the particle (pore former) having an aspect ratio of 300, the kneaded material did not pass through the extrusion die and extrusion of a ceramic formed body was impossible. In Comparative Example 7 not using a particle of a high aspect ratio, the orientation degree was large, and the "pressure loss with soot" was large.

The present invention can be used suitably as a ceramic formed body extrusion method capable of forming a ceramic formed body which contains a particle of a high aspect ratio and in which the particle is oriented such that a length direction of the particle is approximately parallel to a thickness direction of a wall-shaped or plate-shaped formed portion.

DESCRIPTION OF REFERENCE NUMERALS

1: ceramic formed body
2: wall-shaped or plate-shaped formed portion
4: extrusion die
5: raw material supply surface
6: raw material forming surface
7: introduction hole
8: slit, 8*a*: slit former stage unit
8*b*: slit latter stage unit
9*a*: wall surface
9*b*: wall surface
10: particle of high aspect ratio
11: raw material
12: cut surface
13: central region
15: extrusion die

16: raw material supply surface
17: raw material forming surface
18: introduction hole
19: sli

The invention claimed is:

1. A ceramic porous body comprising partition walls having a plurality of pores for defining a plurality of cells, wherein among three regions obtained by equally dividing a cut surface obtained by cutting the ceramic porous body in a thickness direction of the partition walls into three parts in the thickness direction of the partition walls, the orientation degree of the pores in a central region located in the center in the thickness direction of the partition walls is from 0 to 53°, and among the three regions, a difference between a porosity in a surface region outside the central region and a porosity of the partition walls is from 0 to 11%.

2. The ceramic porous body according to claim 1, wherein the porosity of the partition walls is 65% or less.

* * * * *